US006636707B2

(12) United States Patent
Asakawa et al.

(10) Patent No.: US 6,636,707 B2
(45) Date of Patent: Oct. 21, 2003

(54) IMAGE FORMING APPARATUS AND CONTROL METHOD OF SHEET FEEDING THEREIN

(75) Inventors: Minoru Asakawa, Tokyo (JP); Kenichi Hosoi, Tokyo (JP); Takaaki Sakai, Tokyo (JP)

(73) Assignee: Konica Corporation, Tokyo (JP)

( * ) Notice: Subject to any disclaimer, the term of this patent is extended or adjusted under 35 U.S.C. 154(b) by 25 days.

(21) Appl. No.: 10/016,037

(22) Filed: Nov. 16, 2001

(65) Prior Publication Data

US 2002/0061213 A1 May 23, 2002

(30) Foreign Application Priority Data

Nov. 22, 2000 (JP) ..... 2000-355617

(51) Int. Cl.[7] ..... G03G 15/00
(52) U.S. Cl. ..... 399/43; 399/388; 399/407
(58) Field of Search ..... 399/38, 43, 82, 399/388, 407

(56) References Cited

U.S. PATENT DOCUMENTS 5,852,765 A * 12/1998 Yamashita et al. ..... 399/407
5,933,679 A * 8/1999 Palumbo ..... 399/43

* cited by examiner

*Primary Examiner*—Sophia S. Chen
(74) *Attorney, Agent, or Firm*—Frishauf, Holtz, Goodman & Chick, P.C.

(57) ABSTRACT

A control method is provided for sheet-feeding in an image forming apparatus in which a sheet is fed to an image forming section of the image forming apparatus having a finisher which receives the sheet on which the image is formed and finishes the sheet. The control method includes the steps of: conducting a continuous image forming process that makes plural sets of sheets each on which the image has been formed; and controlling a starting of a sheet-feeder which feeds a first sheet of a set of sheets to the image forming section, according to a logical product of a condition on the continuous image forming process in the image forming apparatus and a condition of an operating process in the finisher.

3 Claims, 4 Drawing Sheets

PRIOR ART
FIG. 1 ( a )
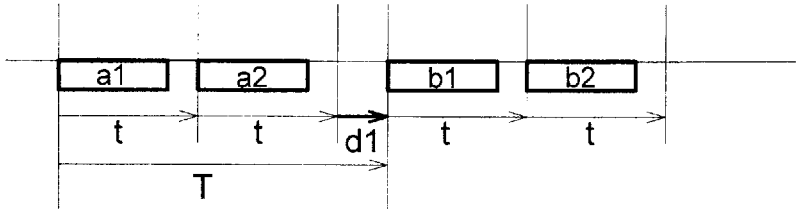
FIG. 1 ( b )
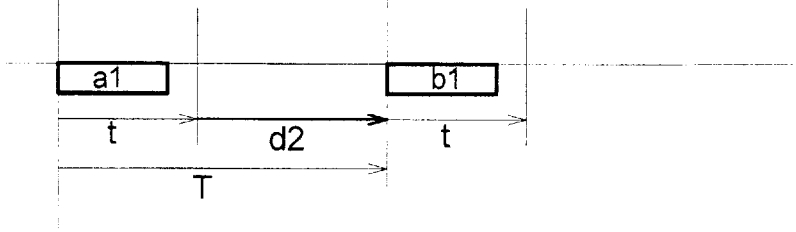

FIG. 4
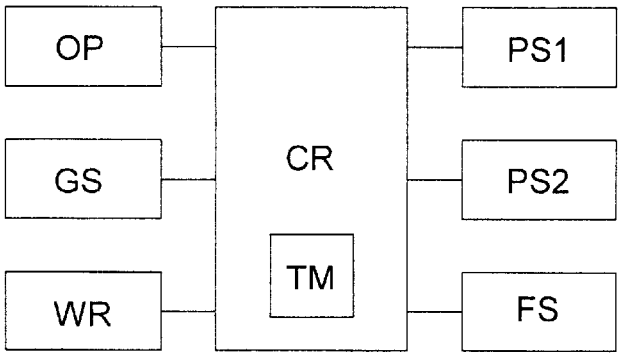
FIG. 5 ( a )
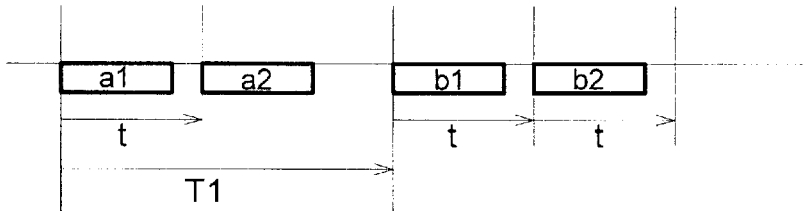
FIG. 5 ( b )
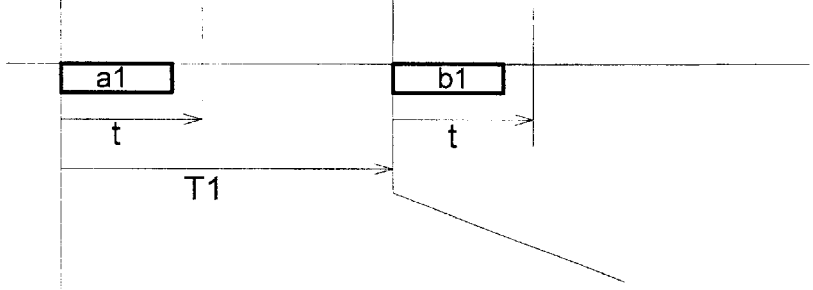
FIG. 5 ( c )
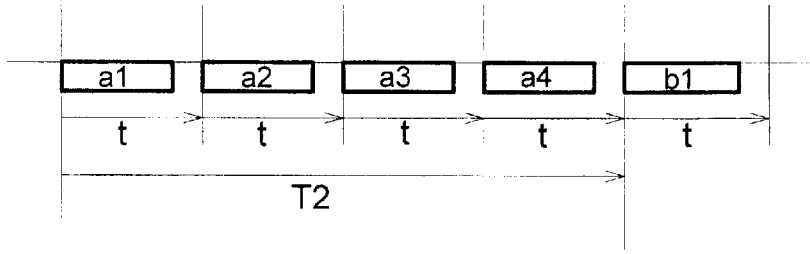

IMAGE FORMING APPARATUS AND CONTROL METHOD OF SHEET FEEDING THEREIN

BACKGROUND OF THE INVENTION

The present invention relates to an image forming apparatus such as a copying machine, a printer and a facsimile machine, and in particular, to a control technology of sheet-feeding in case of feeding a sheet to an image forming section of an image forming apparatus.

In an image-forming apparatus such as a copying machine, a printer and a facsimile machine, a controller is designed so that a plurality of sets of documents representing a plurality of images may be made efficiently. The controller is provided with a continuous interval timer which establishes an interval between each of the sheets in a continuous image forming process appropriately. In addition, the controller controls the operation of the continuous interval timer so that an interval between sets can be set to be different from an interval between sheets.

The control of the continuous interval timer in the above-mentioned continuous image forming process is explained referring to FIG. 1.

In the image forming process, interval "t" between images and interval T between sets are formed by a registration roller representing a second sheet-feeder. A sheet fed from each sheet-feeding cassette is stopped at the registration roller temporarily, and the sheet is conveyed to a transfer device after the registration roller starts operating.

Further, the interval "t" between images is formed by the logical product of a time formed by the continuous interval timer, information of completion for sheet-feeding preparation and an image-formation synchronization signal.

The time formed by the continuous interval timer is established by the parameters such as a size of sheets and an image-forming mode. Information of completion for sheet-feeding preparation is information showing that a certain period of time has passed from the signal of detection for the leading edge of a sheet generated by the sheet sensor provided right on the upstream-side of the registration roller. Though there is a case that the interval T of sets is formed by the summation of the intervals "t" of images for the number of images which constitute each set, there is also a case that the interval formed by the summation of the intervals of images for the number of images is changed by the time for a finishing process, and in this case, considering the time needed for the finishing process, the interval T of sets is formed by adding a correction time to the time formed by the interval timer n×"t" (where n is a number of images constituting one set).

As shown by correction time d1 in FIG. 1(*a*) and by correction time d2 in FIG. 1(*b*), the correction time for forming the interval T of sets has different values depending upon the number of images forming one set. Incidentally, a1 and a2 in FIG. 1(*a*) and FIG. 1(*b*) show the images constituting a first set, while b1 and b2 show the images constituting a second set.

When the interval T of sets in the continuous image forming process is established by correcting the measured time by the continuous interval timer, there is a problem that a time control by the continuous interval timer becomes extremely complex. That is, the time for establishing the interval of images established by the continuous interval timer itself has various kinds of values depending upon sheet sizes and image forming modes. In addition, the calculation that adds the various correction values concerning the finishing process with respect to the various establishing times and control based on the calculation become complex so that the appropriate condition may fail to be established.

SUMMARY OF THE INVENTION

An object of the invention is to solve the above-mentioned problem in the control of the continuous image formation.

The above-mentioned object of the invention is attained by either one of the structures described below.

(1) An image forming apparatus having an image forming section for forming an image on a sheet, a sheet storing section for storing plural sheets, a first sheet-feeder for conveying sheet from the sheet storing section, a second sheet-feeder for receiving a sheet from the first sheet-feeder and for supplying the sheet to the image forming section, a finisher for finishing an image-formed sheet and a controller for controlling sheet-feeding operation of the second sheet-feeder, wherein in the continuous image forming process which makes plural sets of image-formed sheets which are finished by the finisher, the controller controls the starting of the second sheet-feeder that forms the interval of sets based on the logical products of time passing information established by the continuous interval timer that establishes the interval between each sheet, information of completion for sheet-feeding preparation in the second sheet-feeder, image-forming information in the image forming section and information of time passing from the conveyance starting of a first sheet by the second sheet-feeder that is established by the finishing time in the finisher.

(2) A control method of sheet-feeding in an image forming apparatus for supplying a sheet to the image forming section of the image forming apparatus having an image forming section and a finisher which receives the sheet to perform finishing on which an image is formed in the image forming section, wherein in the continuous image forming process that makes a plurality of image-formed sheets, by the logical products of the condition on the image forming process in the image forming apparatus and the condition of operating process in the finisher, the starting of sheet-feeder which supplies the first sheet of the set to the image forming section is controlled.

BRIEF DESCRIPTION OF THE DRAWINGS

FIG. 1(*a*) and FIG. 1(*b*) are time charts showing a sheet-feeding control in a conventional image forming apparatus.

FIG. 4 is a block diagram showing a control system of an image forming apparatus of the embodiment of the invention.

FIG. 5(*a*), FIG. 5(*b*) and FIG. 5(*c*) are time charts showing a sheet-feeding control of the embodiment of the invention.

DETAILED DESCRIPTION OF THE PREFERRED EMBODIMENT

Figure 2:
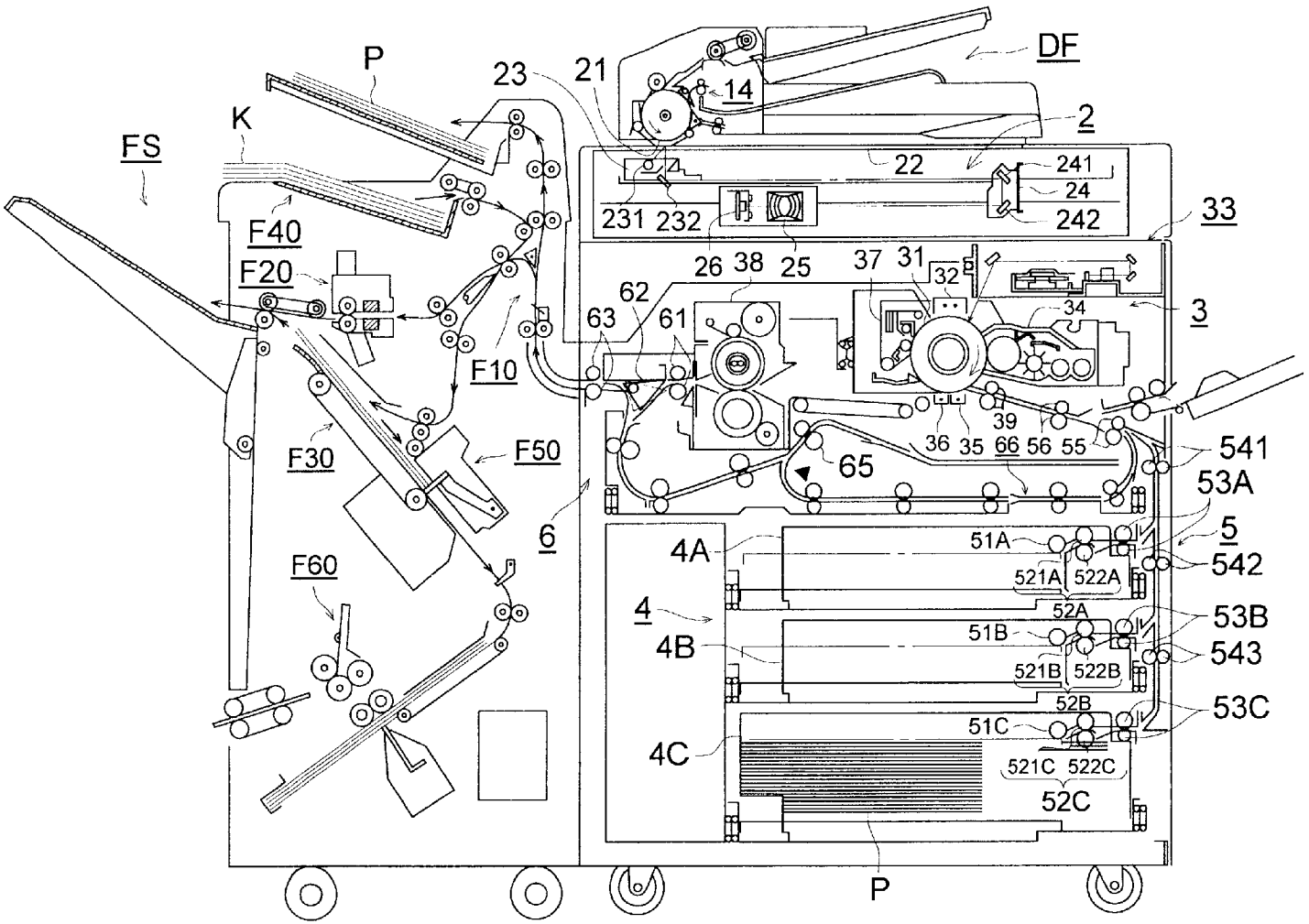
FIG. 2 is a diagram showing an image forming apparatus of the embodiment of the invention.

FIG. 2 shows an image forming apparatus of the embodiment of the invention.

Document feeder DF is structured to be made to hinge integrally, and is structured to set the document directly on the platen glass, by raising up document feeder DF to open the space on platen glass 22. The present embodiment has a reading mode that reads the image of the document, while feeding the document by document feeder DF, and a reading mode that reads the image of the document, placed on the platen glass 22.

Image reading section 2, which is a means for reading an image of the document and obtaining the image data, is provided with slit 21 representing a slit-shaped opening for reading the image of the document conveyed by the document feeder DF, platen glass 22 representing a document stand on which a document is to be placed, first mirror unit 23 in which lamp 231 representing a light source for illuminating the document and first mirror 232 reflecting a reflected light from the document are united integrally, V-mirror unit 24 in which second mirror 241 and third mirror 242 for reflecting the light from the first mirror 232 are united integrally, image forming lens 25 representing an image forming means for forming the reflected light from the document on the slit 21 or the platen glass 22 to under-mentioned CCD 26, and line-shaped CCD 26 representing an image-reading means for obtaining image information through photoelectric conversion of a light image formed by the image forming lens 25.

When the image reading section 2 reads the document that is fed by the document feeder DF, the first mirror unit 23 and the V-mirror unit 24 are positioned under the slit 21 as shown in FIGS. 1(*a*) and 1(*b*). Further, the lamp 231 illuminates the document fed on the slit 21 by the document feeding means 14, and the reflected light from the document enters the COD 26, via the first mirror 232, the second mirror 241, the third mirror 242 and the image forming lens 25. The COD 26 converges the entered light photoelectrically to read the image of the document in the direction of the main scanning direction (i.e. in the direction perpendicular to the page of FIG. 2), and can read the full image of the document, because the document is fed in the direction of the sub-scanning direction by the document feeder DF. The image data read by the CCD 26 are subjected to appropriate image processing, and are transformed to the image by a writing performed by a laser writing system 33 mentioned later.

When the document placed on the platen glass 22 is read, the image of the document can be read by moving the first mirror unit 23 and the V-mirror unit 24 in the right direction along the platen glass 22 in FIG. 2. The document feeder DF and the image reading section 2 constitute a document reading device as mentioned above.

Image forming section 3 is a means for forming an image on sheet P which is fed at the prescribed processing speed that is established in advance, based on image data obtained by the image reading section 2. The image forming section 3 of the present embodiment is one that forms an image using an electrophotographic process. The image forming section 3 is provided with photoreceptor drum 31 representing an image carrier, charging device 32 which charges the photoreceptor drum 31 evenly, laser writing system 33 representing an exposure means which forms a latent image by exposing the photoreceptor drum 31, based on the image data obtained through reading by the CCD 26, developing device 34 which forms a toner image by developing the latent image on the photoreceptor drum 31, transfer device 35 which transfers the toner image carried on the photoreceptor drum 31 to the sheet P, separating device 36 which separates the sheet P on which the toner image is transferred from the photoreceptor drum 31, cleaning means 37 which removes toner remaining on the photoreceptor drum 31 after transferring, and fixing means 38 which fixes a toner image on the sheet P. There are arranged charging device 32, laser writing system 33, developing device 34, transfer device 35, separating device 36, and cleaning means 37 around the photoreceptor drum 31 as illustrated.

By the driving of a motor (not shown), the photoreceptor drum 31 rotates in the direction indicated by the arrow, then the photoreceptor drum 31 is charged evenly by the charging device 32, further, latent image is formed by the laser writing system 33 whose exposure is started in synchronization with a leading edge of the sheet P fed out from registration roller 56 mentioned later, and further, the development is performed by the developing device 34, thus a toner image based on the image data obtained by the reading action by the CCD 26 is formed. The formed toner image is transferred onto the sheet P by the transfer device 35. The sheet P onto which the toner image has been transferred is separated from the photoreceptor drum 31 by the separating device 36, and is fed to the fixing device 38 so that the toner image may be fixed to the sheet P by the heating and pressing function. On the other hand, the photoreceptor drum 31 from which the toner image has been transferred to the sheet P continues rotating furthermore, and the toner remained on the photoreceptor drum 31 is cleared by the cleaning means 37 to be reused for the next image formation.

Incidentally, in the present embodiment, between the photoreceptor drum 31 and the registration paired rollers 56 and near the photoreceptor drum 31, there is provided drum-preceding paired rollers 39 which feeds the sheet P having been sent out from the registration paired rollers 56 representing the second sheet feeding means, which contributes increment of feeding power for the sheet P. Furthermore, between the separating device 36 and the fixing means 38, there are provided a feeding roller (no reference symbol assigned) and a belt (no reference symbol assigned), both of which feed the sheet P which is separated by the separating device 36, with the downside of sheet P holding (the opposite side of the image-formed surface).

In the present embodiment, there are provided multi-decks sheet storing sections 4 representing 4A, 4B, 4C, under the image-forming section 3.

Sheet feeding section 5 is a first sheet feeding means that feeds the sheet P from the sheet storing section 4 to the registration paired rollers 56, and is constituted so that the sheets P contained in each of the sheet storing sections 4A–4C may be fed to the image reading section 3.

Sheet ejection and re-feeding means 6 is a means for ejecting or re-feeding the sheet P having passed through the fixing means 38. This sheet ejection and re-feeding means 6 is provided with fixing ejection paired rollers 61 which ejects the toner image fixed sheet P from the fixing means 38, feeding path switchover means 62 which switches the feeding paths (depending on whether the sheet P ejected from fixing and ejecting paired rollers 61 is ejected to the outside of the apparatus as it is, or whether the sheet P is ejected after it is reversed or is re-fed for forming an image on the back thereof), sheet ejecting paired rollers 63 which eject the sheet P to the outside of the apparatus, sheet reversing and feeding paired rollers 65 representing a sheet reversing and feeding member which feeds the sheet P with switching-back by direct and reverse rotation, and sheet re-feeding section 66 which re-feeds the sheet P reversed by the sheet reversing and feeding paired rollers 65 to the image reading section 3.

When the image-formed sheet P is ejected with its image formed surface facing upward without being reversed, the sheet P is guided by the switchover means 62 to be fed to the finishing device FS. Further, when the image-formed sheet P is reversed to be ejected, that is, when the sheet P is ejected with its image-formed surface facing downward, the sheet P, which is guided by the switchover means 62 and fed by the fixing ejection paired rollers 61, is fed to the direction of the sheet reversing and feeding paired rollers 65 temporarily, and when the sheet P has passed the changeover means 62, its feeding direction is reversed, and the sheet P is ejected to the outside of the apparatus by the sheet ejecting paired rollers 63. On the other hand, when the image is formed on the back of the sheet P, the sheet P, which is guided by the changeover means 62 and fed by the fixing ejection paired rollers 61, is fed to the direction of the sheet reversing and feeding paired rollers 65, and the sheet P is reversed by the switch-back action of the sheet reversing and feeding paired rollers 65, and is fed to the sheet re-feeding section 66. The sheet P, having been fed to the sheet re-feeding section, enters the feeding path of the feeding section 5 between undermentioned loop forming paired rollers 55 and undermentioned intermediate feeding paired rollers 541, and is fed to the image reading section 3, in the same manner as the sheet feeding from the sheet storing section 4.

Next, the conveyance path of the sheet P in the sheet feeding section 5 will be explained. The feeding of the sheet P in the sheet feeding section 5 is performed along the conveyance path (no reference symbol assigned) That is, the sheets P, stored in each of the sheet storing sections 4A–4C, are fed along the conveyance path having individual conveyance paths which feed out the sheets P from the sheet storing sections 4A–4C, a lengthwise conveyance path which feeds the sheets P having been fed out through the individual conveyance paths, and a registration conveyance path which feeds the sheets P having been fed through the lengthwise conveyance path to the image reading section 3. The individual conveyance paths are conveyance paths from the sheet storing sections 4A, 4B, and 4C to pre-registration paired rollers 53A, 53B and 53C, and are provided for each of the sheet storing sections 4A–4C. The lengthwise conveyance path is a conveyance path from the intermediate feeding paired rollers 543 to the loop forming paired rollers 55, where the sheets P having been fed from the sheet storing sections 4B and 4C pass through in common. Incidentally, the sheet P from the sheet storing section 4A is fed from the pre-registration paired rollers 53A to the loop forming paired rollers 55 via intermediate feeding paired rollers 541, without passing through the intermediate feeding paired rollers 542.

The lengthwise conveyance path is a partially common used conveyance path, whose part is representing a common conveyance path on which the sheet P from the sheet storing section 4C and the sheet P from the sheet storing section 4B pass commonly. In the common conveyance path, there are provided intermediate feeding paired rollers 542 which feed the sheet P from the sheet storing section 4C and the sheet P from the sheet storing section 4B commonly, and the intermediate feeding paired rollers 541 which feed the sheet P from the sheet storing section 4C, the sheet P from the sheet storing section 4B, and the sheet P from the sheet storing section 4A commonly.

Next, each constitution (means) of the sheet feeding section 5 will be explained. In the following explanation, since the same kinds of a pick-up roller, a separating and feeding roller, separating and retarding roller, a separating means, a pre-registration roller and a loop forming guide are equipped in each of the sheet storing sections 4A, 4B and 4C, and also have common functions, they will be explained without the indicated symbols such as A, B and C, as far as there is no necessity.

The sheet feeding section 5 is provided with pick-up roller 51, separating means 52 (serving also as a first loop forming means), composed of the separating and feeding roller 521 and the separating and retarding roller 522 which separate sheet P one by one from the sheets P fed out from the pick up roller 51, pre-registration paired rollers 53 representing a first stopper means by which the sheet P having been separated by the separating means 52 is stopped temporarily and is conveyed again, a plurality of intermediate feeding paired rollers 541–543 representing the intermediate feeding means for feeding the sheet P having been fed by the pre-registration paired rollers 53, loop forming paired rollers 55 representing a second loop forming means for feeding the sheet P having been fed by the intermediate feeding rollers, registration paired rollers 56 representing a second stopper means by which the sheet P having been fed by the loop forming paired rollers 55 is stopped temporarily and is restarted again, and a plurality of motors (not shown) representing a driving means for driving each roller. The pick-up rollers 51 and the separating means 52 are provided in each of sheet storing sections 4A, 4B and 4C, and they separate sheet P one by one from the stacked sheets P.

The pick up roller 51 is provided to be capable of being moved vertically by a driving means such as an unillustrated solenoid, and when the pickup roller 51 has moved to the lower position, it is on the individual conveyance path to touch the uppermost sheet of a plurality of the sheets P stored in the sheet storing section 4, and is driven to rotate by an unillustrated driving means, thus the uppermost sheet P can be fed out. Further, when the pickup roller 51 has moved to the higher position, the pick up roller 51 is away from the sheet P. Incidentally, the sheet storing section 4 is pushed up by a means such as an unillustrated bottom plate, so that each of the top positions of a plurality of the sheets P is always kept at the same height.

The separating means 52 is one that separates the sheets P, fed out by the pick up roller 51 into each sheet, and in the present embodiment, the separating means 52 has a separating and feeding roller 521, and separating and retarding roller 522. The separating and feeding roller 521 is a roller that comes into contact with the upper surface of the sheet P being fed, and is rotated by an unillustrated driving means, and it is a roller that feeds the sheet P to the pre-registration paired rollers 53 adjoining the down stream side in the feeding direction of sheet P. The separating and retarding roller 522 is a stopping roller having a built-in torque limiter, and is a roller that separates, one by one, the sheets P fed out from the pick up roller 51, together with the separating and feeding roller 521.

Each of the pre-registration paired rollers 53 represents a first stopper means by which the sheet P separated by the separating means 52 is stopped temporarily and is conveyed again, which is composed of a pair of facing rollers, and is provided on the individual conveyance paths to be capable of being rotated by an unillustrated driving means respectively. Since the pre-registration paired rollers 53 have stopped the rotation when the sheet P is conveyed by the separating means 52, the sheet P thus conveyed hits the pre-registration paired rollers 53 temporarily, and the leading edge of the sheet P is stopped. After that, the pre-registration paired rollers 53 begin to rotate, and the sheet P is fed again by the pre-registration paired rollers 53. In this way, by making the sheet P to hit the pre-registration rollers 53 temporarily, the timing of the leading edge of the sheet P is secured precisely, and uneven conveyance can be controlled.

The present embodiment is constituted to continue the feeding of the sheet P by the separating means 52, even after the leading edge of the sheet P hits the pre-registration paired rollers 53, and due to this, the sheet P whose leading edge is stopped is made to form a loop to correct sheet skewing.

The intermediate rollers 541–543 are intermediate feeding means for feeding the sheet P fed by the pre-registration paired rollers 53. The intermediate rollers 541 are the rollers which feed the sheets P fed by the pre-registration paired rollers 53A–53C, that is, the rollers which feed the sheets P from the sheet storing sections 4A-4C. The intermediate rollers 542 are the rollers which feed the sheets P fed by the pre-registration paired rollers 53B and 53C, that is, the rollers which feed the sheets P from the sheet storing sections 4B and 4C. The intermediate rollers 543 are the rollers which feed the sheets P fed by the pre-registration paired rollers 53C, that is, the rollers which feed the sheets P from the sheet storing section 4C. The loop forming paired rollers 55 are means for feeding the sheet P fed by the intermediate feeding paired rollers 541.

The registration paired rollers 56 representing a second feeding means are second stopper means by which the sheet P fed by the loop forming paired rollers 55 is stopped temporarily and conveyed again, further, which are feeding members to stop and feed the sheet P. The registration paired rollers 56 is not rotating when the sheet P is conveyed to it by the loop forming paired rollers 55, and therefore, the sheet P thus fed hits the registration paired rollers 56 temporarily, and the leading edge of the sheet P is stopped. After that, the registration paired rollers 56 begin to rotate, and the sheet P is fed again by the registration paired rollers 56. Further, the latent image formation by the laser writing system 33 starts, in synchronization with the sheet P fed out from the registration paired rollers 56, and the sheet P and the toner image on the photoreceptor drum 31 are synchronized. In this way, by making the sheet P to hit the registration paired rollers 56 temporarily, the timing of the leading edge of the sheet P can be secured precisely, and uneven conveyance can be controlled, and further, the laser writing system 33 can be easily synchronized to form an image at the precise position on the sheet P.

Figure 3:
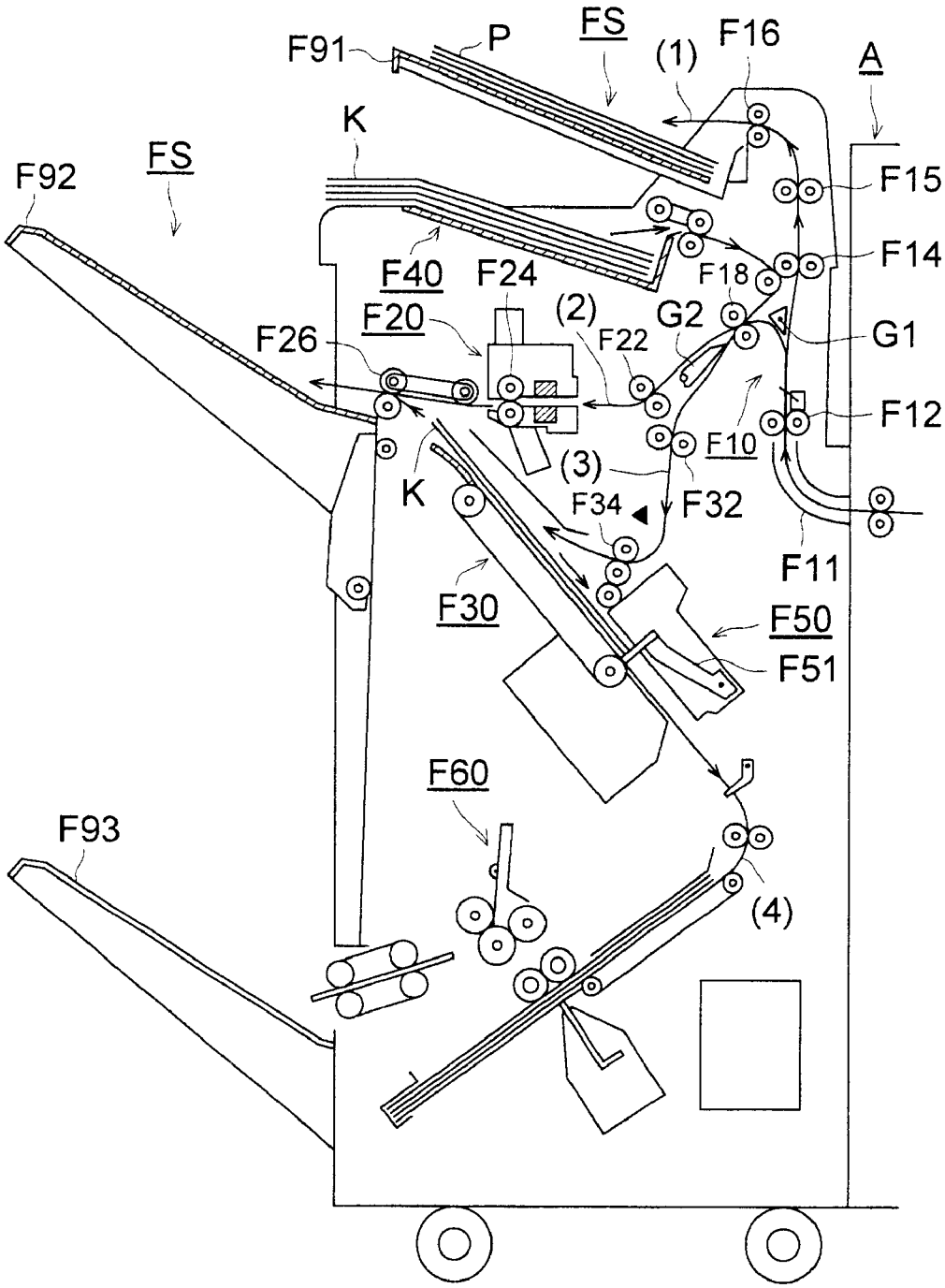
FIG. 3 is a diagram showing a finisher of an image forming apparatus of the embodiment of the invention.

FIG. 3 is a drawing showing a finishing device FS of the present embodiment of the invention. In the finishing device ES, there are arranged fixed sheet ejection tray F91, cover sheet feeding means F40 on which the sheet K is placed. Shift processing section F20, stapling means comprising intermediate stacker E30 and stapler F50, and folding station E60, perpendicularly from the top of the drawing.

Entrance feeding section F10 is arranged at the upper portion on the right side in the drawing of the finishing device FS. Further, there are arranged elevating sheet ejection tray F92 on which the sheets side-stapled and sift-processed are placed, and fixed sheet ejection tray F93 on which the sheets folded in three or the sheets folded in two are placed, on the left side of the drawing of the finishing section FS in the drawing.

The finishing device FS is adjusted in terms of position and height to be installed so that receiving section F11 of the sheet P fed from image forming apparatus main body A may agree with a sheet ejection outlet (no reference symbol assigned) of the image forming apparatus main body A.

Feeding paired rollers F12 is provided on the receiving section F11, and on the downstream side of it, there are arranged $1^{st}$ conveyance path (1) on the upper stage, $2^{nd}$ conveyance path (2) on the middle stage, and $3^{rd}$ conveyance path (3) and $4^{th}$ conveyance path (4) on the lower stage.

The feeding of the sheet P on the $1^{st}$–$4^{th}$ conveyance paths (1)–(4) will be explained as follows.

The $1^{st}$ conveyance path (1) is a sheet ejection path where the image-formed sheets P are ejected to be stacked in the ejecting order. In an ejecting mode using the $1^{st}$ conveyance path, changeover means G1 opens the $1^{st}$ conveyance path (1) and closes the path to feeding rollers F18. The image-formed sheet P ejected from the image forming apparatus main body A is introduced to the receiving section E11 to be fed by the feeding paired rollers F12. The sheet P is guided by changeover means G1 to enter the $1^{st}$ conveyance path (1), and is fed by feeding paired rollers F14, F15 and F16 to be ejected to the fixed sheet ejection tray F91.

The $2^{nd}$ conveyance path (2) is a conveyance path where the image-formed sheets P are ejected to the elevating sheet ejection tray F92 by a sorting process which shifts the sheets P by the prescribed number such as the number of the documents, in the lateral direction of feeding (the direction perpendicular to the direction of feeding, this applies to the following) In the mode using this conveyance path, the changeover means G1 closes the $1^{st}$ conveyance path (1) to open the path to the feeding paired rollers F18, and the changeover means G2 opens the $2^{nd}$ conveyance path (2), and closes the $3^{rd}$ conveyance path (3) The sheet P fed by the feeding paired rollers F12 is fed to the $2^{nd}$ conveyance path (2) to be fed to the shift processing section F20 by the feeding roller F22. Feeding paired rollers F24 in the shift processing section F20 have a shifting function that feeds the sheet P by shifting its position to the lateral direction of the feeding, when it receives the leading edge of the sheet P. The sheet P having passed through the shift processing section F20 is ejected to the elevating sheet ejection tray F92 by the sheet ejecting paired rollers F26.

The $3^{rd}$ conveyance path (3) is a path where a stapling process is performed for the sheets P in quantity of the prescribed number, for example, in quantity of the number of the documents. In the mode using this conveyance path, the changeover means G1 closes the $1^{st}$ conveyance path (2) to open the path to the feeding rollers F18, and the changeover means G2 closes the $2^{nd}$ conveyance path (2), and opens the $3^{rd}$ conveyance path (3). The sheets P are fed by feeding paired rollers F18, F32 and F34 to be sent to the intermediate stacker F30. When the trailing edge of the sheet P leaves the feeding paired rollers F34, the sheet P slides on the intermediate stacker F30 downward and hits movable stopper member F51 to stop. The intermediate stacker F30 is a stacking means for stacking the sheets P, and is also a reversing means for reversing the sheets P in the feeding direction.

When the leading edge of the sheet P or sheet K arrives at the feeding paired rollers F32 and the feeding paired rollers F34, the rollers F32 and F34 stop the sheet P or sheet K temporarily so that the timing for a stapling action at the stapler F50 can be controlled.

Symbol F60 represents a folding device which folds the sheet P and sheet K to thrice-folded or twice-folded formation, and the folded sheets are ejected to a fixed sheet ejection tray F93.

FIG. 4 is a block diagram showing a control system of the embodiment of the invention. Control mean CR having a continuous interval timer TM controls second sheet feeding means PS2 (registration paired rollers 56), by making an establishing condition on operation section OP and a writing order to writing means WR to be the condition of the undermentioned sheet feed control. In the operation section OP, the image forming modes such as the stapling process and the folding process in the finishing section are established.

In the image forming process, the sheet P is fed by the feeding action of the first feeding means PS1 (sheet feeding section 5), and is fed by making the second sheet feeding means PS2 to start moving in synchronization with the writing action in the writing means WR. After an image is formed on the sheet P by the image forming section GS, the finishing device FS is driven to perform the finishing processes such as the stapling process and the folding process.

Next, the control by the control means CR in the embodiment of the invention will be explained referring to FIG. 5 showing the time chart of the image forming process.

In the embodiment, the control means CR forms the interval t between images representing the images a1–a4 and the images b1–b2 by controlling the second sheet feeding means PS2.

The interval t between images is established by the following conditions:

(1) Information of the time passage formed by the continuous interval timer TM, (2) Information of completion for sheet-feeding preparation, and (3) Information of image formation.

For the interval T1 and T2 between sets, the starting time of the second sheet feeding means PS2 is controlled by the logical product of four conditions including the above-mentioned three conditions and the following condition:

(4) Information of the time passage from the starting of feeding of the leading sheet of the set by the registration roller 56, established by the processing time in the finishing device FS.

Each of the interval T1 and T2 between sets is an interval from the time when the leading sheet of the $J^{th}$ set of the sheets P is started to be conveyed by the registration paired rollers 56 to the time when the next set, that is, the leading sheet of the $(J+1)^{th}$ set of the sheets P is started to be conveyed by the registration paired rollers 56. Further, the times mentioned in (4) that are established by the times required for the finishing are prepared beforehand i n a memory as the time from the start of conveyance of the leading sheet of the $J^{th}$ set of the sheets P to the start of conveyance of the leading sheet of the $(J+1)^{th}$ set of the sheets P, and they can be used by being selected for each process.

(1) The time interval formed by the continuous interval timer TM is established by the sizes of sheets and the image forming modes. That is, the time interval is established by the sheets sizes such as A4 and B4 and the difference between an ejecting mode that ejects the image-formed sheets without reversing and an ejecting mode that ejects the sheets after reversing. Information of the time passage formed by the continuous interval timer TM becomes H (high) level when the time passage comes.

(2) Information of completion for sheet-feeding preparation becomes H (high) when the prescribed time, that is necessary for forming a loop has passed, after the leading edge of the sheet is detected by a sheet sensor (unillustrated) arranged between the loop forming paired rollers 55 and the registration paired rollers 56.

(3) Image forming information is information showing that the image has been formed on the photoreceptor 31 so that the image on the photoreceptor 31 may be superposed on the sheet p in a precise positional relationship. Further, it is information that becomes H (high), after the time established based on the starting time of writing, from the relationship between the distance on the photoreceptor 31 from a writing position by the writing system 33 to the transfer device 35 and the distance from the registration paired rollers 56 to the transfer device 35.

In the present embodiment, information of (1)–(3) mentioned above plus information of (4) are representing the sheet-feeding-control establishing condition That is, the interval T between sets is established by the logical products of information of (1)–(4).

In FIGS. 5(*a*)–5(*c*), the interval t between images and the intervals T1 and T2 between sets are established by the driving time of the second sheet feeding means PS2 which is established by the control of the control means CR. Further, the interval t of images is formed by the logical products of the above-mentioned (1)–(3).

Since the interval T of sets has a part which does not relate to the number of the images, certain interval T1 between sets is formed, when each set in FIG. 5(*a*) is composed of two images, and when each set in FIG. 5(*b*) is composed of one image. Among time components of the interval T between sets, one of parts unrelated to the number of images constituting the sets is the time necessary for finishing in the finishing device FS. That is, in cases of FIGS. 5(*a*) and 5(*b*), the interval T1 between sets is determined by the time necessary for finishing. On the other hand, when the set is composed of four images as shown in FIG. 5(*c*), the interval T2 of sets is decided by the interval t of images, namely, it is decided by the interval t of images decided by the logical products of above-mentioned (1)–(3).

In the present embodiment as mentioned above, the interval between sets in which the finishing is considered is formed by the control theory which is extremely simple. Accordingly, the various intervals between sets in which the sizes of sheets and the image forming modes are considered can be established without mistake.

By the invention described above in connection with Structure 1 or 2, it has become possible to establish the interval between sets in which conditions for finishing are properly considered for various combination of sizes of sheets and image forming modes. Accordingly, an image forming apparatus which can process a continuous image forming operation at high image forming efficiency can be realized.

What is claimed is:

1. A control method of sheet-feeding in an image forming apparatus in which a sheet is fed to an image forming section of the image forming apparatus having a finisher which receives the sheet on which the image is formed and finishes the sheet, the control method comprising the steps of:

conducting a continuous image forming process that makes plural sets of sheets each on which the image has been formed; and controlling a starting of a sheet-feeder which feeds a first sheet of a set of sheets to the image forming section, according to a logical product of a condition on the continuous image forming process in the image forming apparatus and a condition of an operating process in the finisher.

2. The control method of claim 1, wherein the condition on the continuous image forming process in the image forming apparatus comprises:

time passing information established by a continuous interval timer that establishes an interval between each sheet, information indicating that a sheet-feeding preparation in the sheet-feeder is completed, and information indicating that an image formation on the image forming section is completed, and wherein the condition of the operating process in the finisher comprises the step of providing information of a time passing from a conveyance starting of a first sheet by a second sheet-feeder that is established by a finishing time in the finisher.

3. An image forming apparatus comprising:

(a) an image forming section for forming an image on a sheet;

(b) a sheet storing section for storing a plurality of sheets;

(c) a first sheet-feeder for feeding a sheet from the sheet storing section;

(d) a second sheet-feeder for receiving the sheet fed from the first sheet-feeder and for feeding the sheet to the image forming section;

(e) a finisher for finishing the sheet on which the image has been formed by the image forming section; and (f) a controller for controlling a sheet-feeding operation of the second sheet-feeder, wherein in a continuous image forming process for making plural sets of image-formed sheets each being subjected to a finishing operation by the finisher, the controller controls a starting of the second sheet-feeder that forms an interval between the sets, according to a logical product of;

(1) time passing information established by a continuous interval timer that establishes an interval between each sheet, (2) information indicating that a sheet-feeding preparation in the second sheet-feeder is completed, (3) information indicating that an image formation in the image forming section is completed, and (4) information of a time passing from a conveyance starting of a first sheet fed by the second sheet-feeder that is established by a finishing time in the finisher.

* * * * *